US012690730B2

(12) United States Patent
Muraoka et al.

(10) Patent No.: US 12,690,730 B2
(45) Date of Patent: Jul. 28, 2026

(54) COUNTERBALANCED TOILET SEAT AND COVER

(71) Applicant: Kohler Co., Kohler, WI (US)

(72) Inventors: Hiroyuki Muraoka, Milwaukee, WI (US); John O. Lipinski, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 58 days.

(21) Appl. No.: 18/432,797

(22) Filed: Feb. 5, 2024

(65) Prior Publication Data

US 2024/0285133 A1 Aug. 29, 2024

Related U.S. Application Data

(60) Provisional application No. 63/447,964, filed on Feb. 24, 2023.

(51) Int. Cl.

| | |
|---|---|
| ***A47K 13/10*** | (2006.01) |
| ***A47K 13/12*** | (2006.01) |
| ***E03D 5/10*** | (2006.01) |

(52) U.S. Cl.

CPC ..... *A47K 13/10* (2013.01); *A47K 13/12* (2013.01); *E03D 5/10* (2013.01)

(58) Field of Classification Search

CPC ..... A47K 13/10

See application file for complete search history.

(56) References Cited

U.S. PATENT DOCUMENTS

| | | | | |
|---|---|---|---|---|
| 4,785,482 | A | 11/1988 | Nelva-pasqual | |
| 6,263,517 | B1 * | 7/2001 | Brooks | A47K 13/10 4/246.1 |
| 7,293,297 | B2 | 11/2007 | Hayashi et al. | |
| 7,386,895 | B2 | 6/2008 | Hayashi | |
| 7,475,437 | B2 | 1/2009 | Herrera-gurrola | |
| 10,674,880 | B2 | 6/2020 | Onodera | |
| 10,791,888 | B1 | 10/2020 | Doctor | |
| 11,014,111 | B2 | 5/2021 | Wang | |
| 11,419,463 | B2 | 8/2022 | Chung | |
| 2004/0049840 | A1 * | 3/2004 | Berring | A47K 13/105 4/234 |

(Continued)

FOREIGN PATENT DOCUMENTS

| | | |
|---|---|---|
| CN | 104586310 A | 5/2015 |
| CN | 204971085 U | 1/2016 |

(Continued)

OTHER PUBLICATIONS

Extended European Search Report from European Patent Application No. 24158841.7, dated Jul. 3, 2024, 7 pages.

(Continued)

*Primary Examiner* — Christine J Skubinna

(74) *Attorney, Agent, or Firm* — Lempia Summerfield Katz LLC

(57) ABSTRACT

A toilet includes a base, a seat rotatably coupled to the base, a first counterweight fixedly coupled to the seat, wherein the first counterweight causes a center of mass of the seat to be spaced from a geometric center of the seat, a cover rotatably coupled to the seat, and a second counterweight fixedly coupled to the cover. The second counterweight causes a center of mass of the cover to be spaced from a geometric center of the cover.

17 Claims, 15 Drawing Sheets

(56) References Cited

U.S. PATENT DOCUMENTS

| | | | | |
|---|---|---|---|---|
| 2007/0151007 | A1* | 7/2007 | Wilkinson | A47K 13/10 4/246.1 |
| 2012/0180207 | A1* | 7/2012 | Murillo | A47K 13/10 4/246.1 |
| 2013/0263369 | A1 | 10/2013 | Embler | |
| 2018/0360277 | A1* | 12/2018 | Henderson | A47K 13/10 |
| 2021/0106191 | A1* | 4/2021 | Chung | A47K 13/247 |

FOREIGN PATENT DOCUMENTS

| | | | |
|---|---|---|---|
| CN | 109907681 | A | 6/2019 |
| EP | 3773104 | A1 | 2/2021 |
| JP | H08308768 | A | 11/1996 |
| JP | 2004267227 | A | 9/2004 |
| JP | 2005348883 | A | 12/2005 |
| JP | 2015223329 | A | 12/2015 |
| JP | 2016077396 | A | 5/2016 |
| JP | 6770381 | B2 | 9/2020 |
| KR | 20020040999 | A | 5/2002 |
| WO | 2018000464 | A1 | 1/2018 |

OTHER PUBLICATIONS

Chinese Office Action for Chinese Application No. 202410207600.9 dated Dec. 1, 2026, 12 pages (with English summary).

* cited by examiner

COUNTERBALANCED TOILET SEAT AND COVER

CROSS-REFERENCE TO RELATED APPLICATION

This application claims the benefit of and priority to U.S. Provisional Patent Application No. 63/447,964, filed Feb. 24, 2023, which is incorporated herein by reference.

FIELD

The present disclosure relates generally to toilets. More specifically, the present disclosure relates to toilets having features that improve the efficiency of powered components of toilets.

BACKGROUND

In some conventional toilets, the toilet covers and seats are typically hingably attached to a portion of a toilet base, such that a user can raise the front of each of the cover and the seat from a closed or lowered position to an open or stowed position. The cover and the seat each pivot about a horizontal axis between the lowered position and the stowed position. However, it is often difficult to maintain both the cleanliness of the toilet, particularly at the hinge location, and the overall look and aesthetics of the toilet with this traditional configuration and movement.

BRIEF DESCRIPTION OF THE DRAWINGS

Exemplary embodiments are described herein with reference to the following drawings, according to an exemplary embodiment.

DETAILED DESCRIPTION

Figure 2:
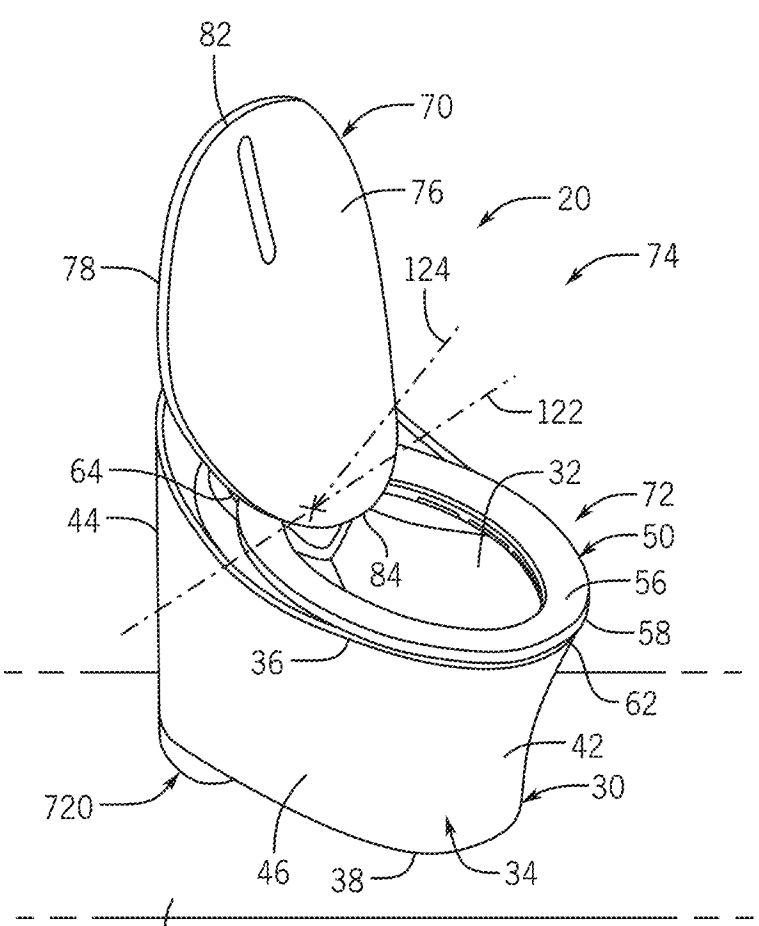
FIG. 2 is a perspective view of the toilet of FIG. 1 with the cover in a stowed position and the seat in a lowered position.

As shown in the exemplary embodiment of FIGS. 1-13, the toilet 20 includes a cover and seat opening mechanism that allows both a cover 70 and a seat 50 to be easily moved relative to the toilet 20 and to maintain the cleanliness (in particular during use) of the toilet 20. Generally, tankless toilets are illustrated. However, the cover and seat opening mechanism that allows both the cover 70 and the seat 50 to be efficiently opened and closed may be applied to any type of toilet, including those with a tank. Cleanliness is maintained because the hinge location and other opening and closing mechanism are located spaced apart from the opening of the bowl. Movement of the cover 70 and seat 50 is made easy (e.g., energy efficient) by counterweights that balance the weight of the cover 70 and seat 50 along or near the pivot axis of rotation.

An example seat opening (and closing) mechanism 120 is described in more detail below. The opening mechanism 120 allows the cover 70 and the seat 50 to each be pivoted upward then rotated backward about two different axes in order to move between a lowered position 72 and a stowed position 74. Specifically, the cover 70 and the seat 50 are each first pivoted upward about a substantially lateral axis 122 to a certain angle and then swiveled or rotated backward about an angled axis 124 (e.g., pivot axis) to move from the lowered position 72 into the stowed position 74. The transverse or lateral axis 122 (i.e., the y-axis) refers to a direction extending horizontally along the width of the base 30 such as the width of a base body 34 (or skirt) or bottom surface 38 of the base body 34 that abuts the floor 10. The base 30 may rest on support 720 on the floor 10. The lateral axis 122 that the cover 70 and the seat 50 first pivot about may be the same lateral axis or two parallel lateral axes. The angled axis 124 is an axis that extends at an angle relative to the vertical and longitudinal axes where the vertical axis (i.e., the z-axis) extends vertically along the height of the base 30 and the longitudinal axis (i.e., the x-axis) extends horizontally along the depth of the base 30 (i.e., between the front end 42 and the back end 44 of the base 30) and is substantially perpendicular to the lateral axis 122. Alternatively, the angled axis 124 extends substantially along the vertical axis. The angled axis 124 extends the cover 70 and lengthwise through the opening of the ring of the seat 50. The lateral axis (i.e., the y-axis), the vertical axis (i.e., the z-axis), and the longitudinal axis (i.e., the x-axis) are substantially perpendicular to each other.

Figure 1:
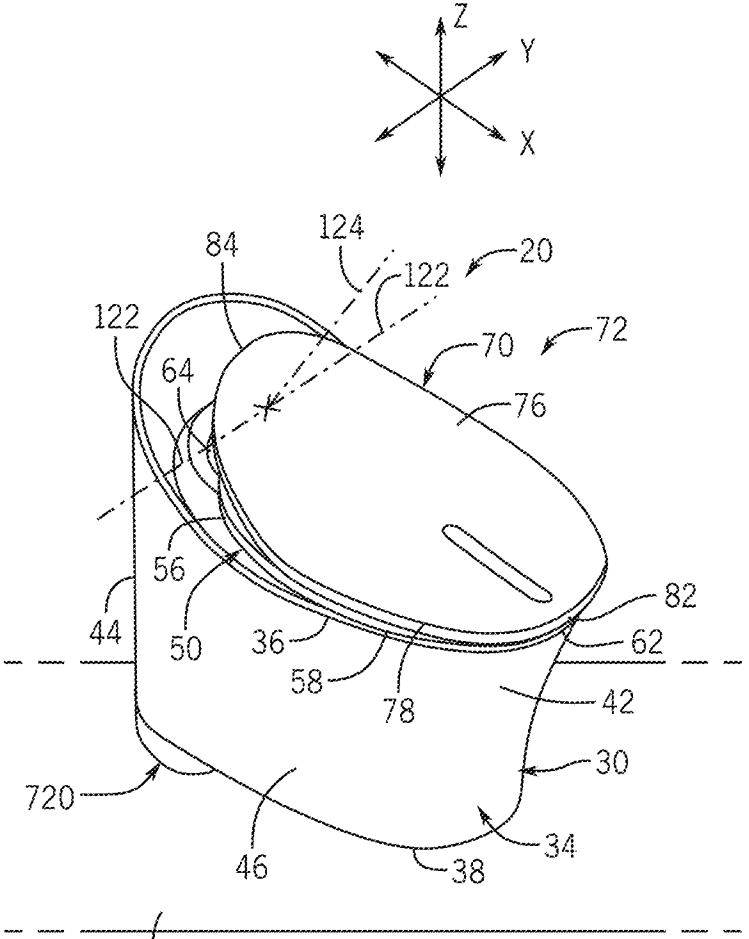
FIG. 1 is a perspective view of a toilet according to an exemplary embodiment.

A hinge, pivot, or the opening mechanism allows each of the cover 70 and the seat 50 to be moved between a lowered position 72, in which the cover 70 and seat 50 are located adjacent a base 30 (as shown in FIG. 1), and a stowed position 74, in which the cover 70 and the seat 50 are oriented in an upward direction away from the base 30 (as shown in FIG. 2). The cover 70 and the seat 50 may be moved individually and separately (i.e., at different times). Alternatively, the cover 70 and the seat 50 may be moved together (i.e., at the same time) and may be moved aligned with each other or misaligned with each other, according to a user's preference. In order to allow the cover 70 and the seat 50 to move between the lowered position 72 and the stowed position 74, the opening mechanism 120 includes shaft or joint between the cover 70 and the base 30.

A front end 82 and a back end 84 of the cover 70 and are positioned toward or closer to the back end 84 of the cover 70 along a bottom surface 78 of the cover 70 such that the majority of the cover 70 (i.e., a top surface 76 and the bottom surface 78) is positioned between the opening mechanism 120 and the front end 82 of the cover 70, and the back end 84 of the cover 70 is spaced apart from and extends beyond the opening mechanism 120 along the length of the cover 70.

The cover 70, the seat 50, and the base 30 are each movably attached to each other toward the respective back ends of each of the cover 70, the seat 50, and the base 30 via the opening mechanism 120 (i.e., the cover 70 and the seat 50 are attached to an area of the base 30 that is closer to the back end 44 of the base 30). Accordingly, the opening mechanism 120 is positioned toward the back end 84 of the cover 70 along the bottom surface 78 of the cover 70. The opening mechanism 120 may include a ring positioned at the back end 64 of the seat 50 that extends from the bottom surface 58 of the seat 50. The socket 132 is positioned toward the top and the back end 44 of the base 30 (e.g., near or at the back of the top rim 36 of the base 30).

A motor within the base 30 is configured to move the cover 70 and the seat 50 relative to the base 30 (however, according to another embodiment, the cover 70 and the seat 50 may be each moved manually by the user, instead of using a motor). Each of the cover 70 and the seat 50 are configured to be moved relative to the base 30 between the lowered position 72 and the stowed position 74.

The cover 70 and the seat 50 move relative to the base 30. The toilet 20 is in the non-use position when the cover 70 and the seat 50 are in the lowered position 72. Accordingly, the bowl 32 (shown in FIG. 2) is concealed. In the non-use position of the toilet 20, the bottom surface 58 of the seat 50 is directly next to the top rim 36 of the base 30 and the top surface 56 of the seat 50 is directly next to the bottom surface 78 of the cover 70 such that the seat 50 is sandwiched between the base 30 and the cover 70. In the non-use position, the cover 70, the seat 50, and the top rim 36 of the base 30 are located adjacent each other.

In order to move the cover 70 from the lowered position 72 into the stowed position 74, the cover 70 is first partially raised by pivoting the cover 70 upward about the lateral axis 122 to a cover pivot angle. By pivoting the cover 70 about the lateral axis 122, the front end 82 of the cover 70 is lifted vertically upward away from the front end 42 (and the top rim 36) of the base 30 and the front end 62 of the seat 50 such that the cover 70 is angled at the cover pivot angle above the top surface 56 of the seat 50. The cover pivot angle 186, which is the angle between the bottom surface 78 of the cover 70 and the top surface 56 of the seat 50, may be a variety of different angles in which the cover 70 is raised upward above the seat 50 and the base 30, but not yet fully upright yet (e.g., the cover pivot angle 186 may be approximately 35° away from the top rim 36 of the base 30).

After pivoting the cover 70 about the lateral axis 122, the cover 70 is then subsequently rotated approximately 180° backward (i.e., away from the front end 42 of the base 30), about the angled axis 124 toward the back end 44 of the base 30 into the stowed position 74.

The cover 70 is rotated such that the top surface 76 of the cover 70 is always visible and facing away from the base 30, and the bottom surface 78 of the cover 70 is always obscured or hidden and facing toward the base 30. More specifically, in the lowered position 72, the top surface 76 of the cover 70 is visible and facing away from the top rim 36 and the bowl 32 of the base 30 and the bottom surface 78 of the cover 70 is obscured and facing toward the top rim 36 and the bowl 32 of the base 30. In the stowed position 74, the top surface 76 of the cover 70 is visible and facing toward and visible from the front end 42 of the base 30, and the bottom surface 78 of the cover 70 is obscured and facing toward the back end 44 of the base 30 in the stowed position 74.

As the cover 70 moves between the lowered position 72 and the stowed position 74, the seat 50 may stay still in the same position. As the cover 70 rotates about the angled axis 124, the cover 70 moves from a partially horizontal (i.e., angled) orientation, in which the top surface 56 of the seat 50 and the bowl 32 are still partially obscured into an upward orientation away from the base 30, in which the top surface 56 of the seat 50 and the bowl 32 are exposed.

While the cover 70 is in the stowed position 74 and the seat 50 is in the lowered position 72, the inside of the base 30 (i.e., the bowl 32) is exposed and the user may therefore use the toilet 20. For example, the user may sit down on the top surface 56 of the seat 50, and optionally rest their back on the top surface 76 of the cover 70, in order to use the toilet 20 in this position.

While the cover 70 is in the stowed position 74 (regardless of the position of the seat 50), the back portion 184 of the cover 70 obscures or covers the portion of the opening mechanism 120 that extends outside of the base 30. More specifically, the back end portion 84 of the cover 70 covers, obscures, blocks, or shields the portion of the cover 70 and the portion of the seat 50 that extend outside of base 30 from being exposed to the bowl 32 when the cover 70 is in the stowed position 74.

The seat 50 is moved from the lowered position 72 to the stowed position 74 in a similar manner that the cover 70 is moved. In order to move the seat 50 from the lowered position 72 to the stowed position 74, the seat 50 is first partially raised by pivoting the seat 50 upward about the lateral axis 122 to a seat pivot angle. By pivoting the seat 50 about the lateral axis 122, the front end 62 of the seat 50 is lifted vertically upward away from the front end 42 of the base 30 such that the seat 50 is angled at the seat pivot angle above the top rim 36 of the base 30. The seat pivot angle, which is the angle between the bottom surface 58 of the seat 50 and the top rim 36 of the base 30, may be a variety of different angles in which the seat 50 is raised upward above the base 30, but not yet fully upright yet (e.g., the seat pivot angle may be approximately 17° away from the top rim 36 of the base 30). The seat pivot angle and the cover pivot angle may be the same as or different from each other.

After pivoting the seat 50 about the lateral axis 122, the seat 50 is subsequently rotated approximately 180° backward (i.e., away from the front end 42 of the base 30), about the angled axis 124 toward the back end 44 of the base 30 into the stowed position 74. By rotating the seat 50 about the angled axis 124, the seat 50 is moved from a position in which the majority of the seat 50 is in front of the open mechanism 120 (i.e., closer to the front end 42 of the base 30), through a position in which the majority of the seat 50 is behind (or partially above) the open mechanism 120 (i.e., closer to the back end 44 of the base 30). Accordingly, as the seat 50 rotates about the angled axis 124, the seat 50 moves toward and then away from one side 46 of the base 30. Furthermore, by rotating the seat 50 about the angled axis 124 while the cover 70 is in the stowed position 74, the majority of the seat 50 moves from the front of the cover 70, which corresponds to the top surface 76, to the back of or behind the cover 70, which corresponds to the bottom surface 78.

The seat 50 is rotated such that, in the lowered position 72, the top surface 56 of the seat 50 faces away from the bowl 32 and the top rim 36 of the base 30, and the bottom surface 58 of the seat 50 faces toward the bowl 32 and the top rim 36 of the base 30. In the stowed position 74, the top surface 56 of the seat 50 faces toward the front end 42 of the base 30 and the bottom surface 78 of the cover 70, and the bottom surface 58 of the seat 50 faces toward the back end 44 of the base 30. As the seat 50 rotates about the angled axis 124, the seat 50 moves from a partially horizontal (i.e., angled) position adjacent the base 30, in which the top rim 36 of the base 30 is still partially obscured into an upward or substantially upright orientation, in which the top rim 36 of the base 30 is exposed.

While the cover 70 and the seat 50 are in the stowed position 74, the top rim 36 and the bowl 32 of the base 30 are exposed and the user may therefore use the toilet 20. For example, the user may use the toilet 20 while standing and thus facing the top surface 76 of the cover 70 in this position.

It is understood that, in order to move the cover 70 and the seat 50 back from the stowed position 74 to the lowered position 72, the cover 70 and the seat 50 are moved in the same, but opposite, manner as described above.

As shown, when the cover 70 and the seat 50 are in the lowered position 72, the seat 50 is positioned between the cover 70 and the top rim 36 of the base 30 such that the cover 70 covers and obscures the seat 50. Additionally, when the cover 70 and the seat 50 are in the stowed position 74, the seat 50 is positioned between the cover 70 and the back end 44 of the base 30 such that the cover 70 also covers and obscures the seat 50 in this position.

Figure 3:
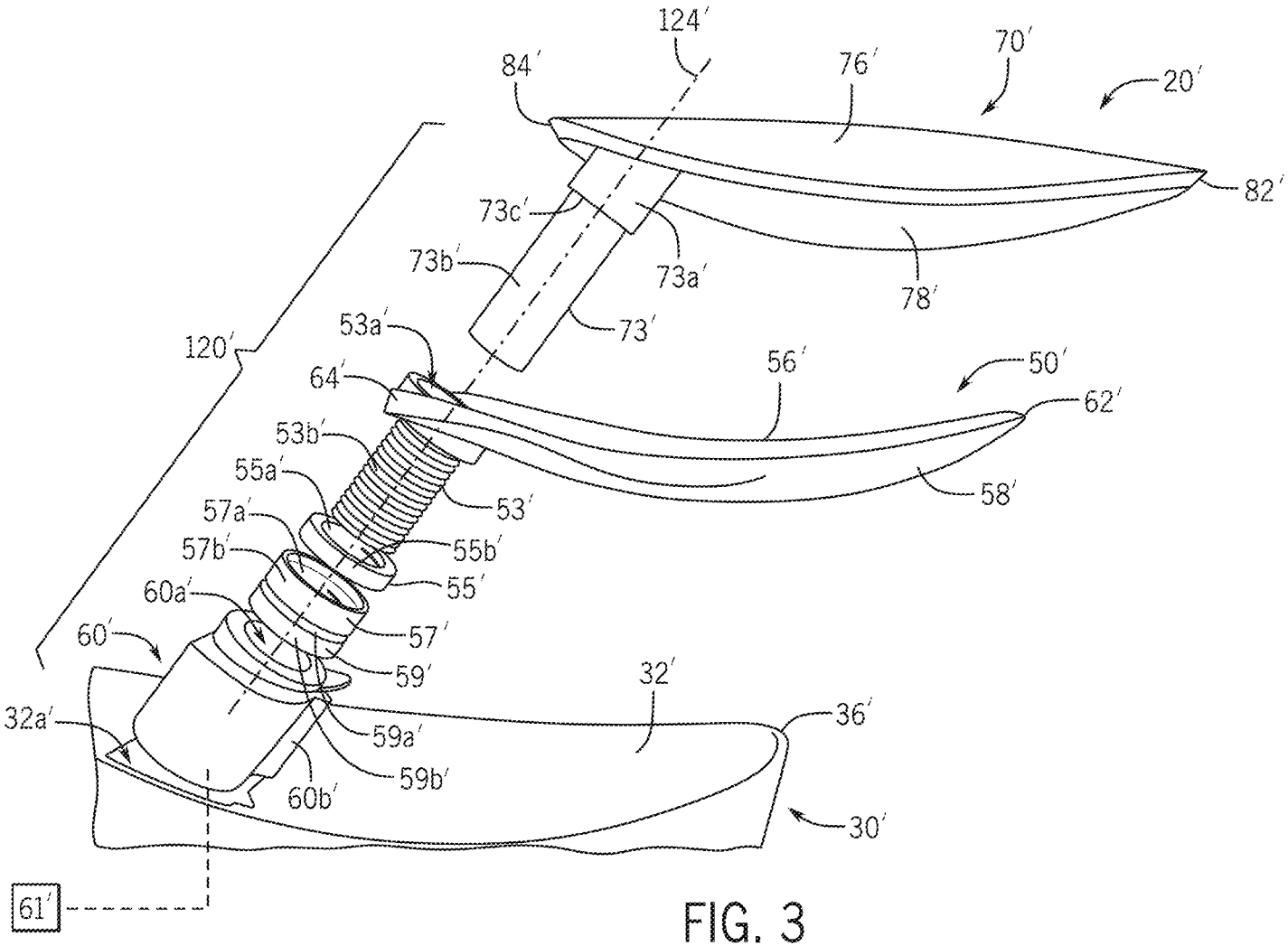
FIG. 3 is an exploded view of a cover and seat opening mechanism of the toilet.

According to another exemplary embodiment shown in FIG. 3, the toilet 20' includes a cover and seat opening mechanism 120' that allows both a cover 70' and a seat 50' to be easily moved relative to the toilet 20' and to maintain the cleanliness (in particular during use) of the toilet 20', similar to the opening mechanism 120 of the toilet 20 discussed above. For ease of movement of the cover 70', a counterweight 111 balance the cover 70' and a counterweight 112 balances the seat 50'. In addition, the counterweights 111 and 112 reduce the energy or power required for motor 61' to move the cover 70' and seat 50'.

As shown in FIG. 3, the toilet 20' includes a cover 70', a seat 50', and a base 30'. The cover 70', the seat 50', and the base 30' have a similar structural configuration as the corresponding cover 70, seat 50, and base 30 of the toilet 20 discussed above, except that the cover 70', the seat 50', and the base 30' include features that cooperatively define an opening mechanism 120' that is different than the opening mechanism 120. The opening mechanism 120' can, advantageously, allow for the cover 70' and the seat 50' to each be rotated about an angled axis 124' between a lowered position 72', in which the cover 70' and the seat 50' are located adjacent the base 30', and a stowed position 74', in which the cover 70' and the seat 50' are oriented in an upward direction away from the base 30', the details of which are discussed in the paragraphs that follow. The cover 70' and the seat 50' may be moved individually and separately (i.e., at different times). Alternatively, the cover 70' and the seat 50' may be moved together (i.e., at the same time) and may be moved aligned with each other or misaligned with each other, according to a user's preference.

The cover 70' and the seat 50' can be rotated in a similar manner as the cover 70 and seat 50 of the toilet 20 discussed above. However, the cover 70' and the seat 50' only rotate about a single, angled axis 124' between the lowered position 72' and the stowed position 74', instead of two different axes (e.g., a lateral axis 122 and an angled axis 124). The rotational movement of the cover 70' and the seat 50' is enabled by the opening mechanism 120'.

As shown in FIG. 3, the opening mechanism 120' is cooperatively defined by features of the cover 70', the seat 50', a housing 60', and the base 30'. For example, the cover 70' includes a top surface 76' having a generally convex shape or portion, and a bottom surface 78' located opposite the top surface 76' having a generally concave shape or portion. The cover 70' further defines a front end 82' and a back end 84' located opposite the front end 82'. The cover 70' includes an elongated member 73' extending outwardly away from the bottom surface 78' toward the back end 84'. The elongated member 73' has a generally cylindrical shape defined by a first portion **73*a*' and a second portion 73*b*' extending from the first portion 73*a*'. The elongated member 73' may include one or more openings extending therethrough to receive, for example, a fluid conduit, electrical wiring, or other components of the cover 70'. The first portion 73*a*' has a diameter that is greater than the diameter of the second portion 73*b*', so as to define a flange 73*c*' for limiting an axial position of the cover 70' relative to the seat 50', the details of which are discussed in the paragraphs that follow. The elongated member 73' also defines the angled axis 124' for the cover 70'** to rotate about, as discussed in greater detail below.

The seat 50' includes a top surface 56' having a generally convex shape that is complementary to the surface profile of the bottom surface 78' of the cover 70'. The seat 50' further includes a bottom surface 58' located opposite the top surface 56'. The seat 50' further defines a front end 62' and a back end 64' located opposite the front end 62'. The seat 50' includes a substantially hollow elongated member 53' extending outwardly away from the bottom surface 58' toward the back end 64'. The hollow elongated member 53' has a generally hollow cylindrical shape that defines an opening **53*a*' extending through the top surface 56' of the seat and through the entire length of the hollow elongated member 53'. The hollow elongated member 53' may receive the elongated member 73' of the cover 70' through at least a portion of, or the entire length of, the opening 53*a*'**.

According to an exemplary embodiment, the opening **53*a*' is countersunk to define an inner flange for engaging the flange 73*c*' of the elongated member 73' near the top surface 56', so as to limit the axial position of the cover 70' relative to the seat 50' to permit relative rotational movement between the cover 70' and the seat 50'. The cover 70' can rotate relative to the seat 50' via the elongated member 73' within the opening 53*a*' of the hollow elongated member 53'. Likewise, the seat 50' can rotate relative to the cover 70' via the hollow elongated member 53'. As such, both the elongated member 73' and the hollow elongated member 53' cooperatively define the same angled axis 124'. As shown in FIG. 3, the hollow elongated member 53' also includes an outer surface having an outer thread 53*b*' for threadably engaging a first rotatable member 55'. The first rotatable member 55' has a ring shape that defines an inner thread 55*a*' and an outer surface 55*b*'. The inner thread 55*a*' may selectively threadably engage the outer thread 53*b*' to permit translational movement of the seat 50' and the cover 70' in an axial direction along the angled axis 124'**.

Still referring to FIG. 3, the opening mechanism 120' further includes a second rotatable member 57' for coupling to the elongated member 73'. For example, the elongated member 73' may have a length sufficient to extend through the opening **53*a*' at a distal end of the hollow elongated member 53', such that the second rotatable member 57' can couple to a portion of the elongated member 73' that extends through the opening 53*a*'. The second rotatable 57' has a ring shape that defines an inner surface 57*a*' and an outer surface 57*b*'. The inner surface 57*a*' may be fixedly coupled to an outer surface of the second portion 73*b*' of the elongated member 73'. According to an exemplary embodiment, the outer surface 57*b*' may define one or more gear teeth for engaging one or more separate drive gears of a motor 61', shown schematically in FIG. 3. For example, the motor 61' may be an electric motor that includes one or more separate drive gears including gear teeth that can rotatably engage complementary gear teeth on the outer surface 57***b*' of the second rotatable member 57', so as to selectively rotate the second rotatable member 57' and the cover 70' about the angled axis 124' via the elongated member 73' in response to a user input (e.g., via a controller described herein). According to other exemplary embodiments, the motor 61' may be configured to engage and rotate the second rotatable member 57' in other ways besides a gear arrangement, such as rotatable bearings, a belt drive, etc. In this manner, the cover 70' can be automatically, and independently, rotated about the angled axis 124' via the motor 61'.

Still referring to FIG. 3, the opening mechanism 120' further includes a third rotatable member 59' for coupling to the hollow elongated member 53'. The third rotatable member 59' has a ring shape that defines an inner surface 59*a*' and an outer surface 59*b*'. The inner surface 59*a*' may be fixedly coupled to the second portion (outer thread 53*b*') of the hollow elongated member 53'. According to an exemplary embodiment, the outer surface 59*b*' may define one or more gear teeth for engaging one or more separate drive gears of the motor 61'. For example, the motor 61' may be an electric motor that includes one or more separate drive gears including gear teeth that can rotatably engage complementary gear teeth on the outer surface 59*b*' of the third rotatable member 59', so as to selectively rotate the third rotatable member 59' and the seat 50' about the angled axis 124' via the hollow elongated member 53' in response to a user input. According to other exemplary embodiments, the motor 61' may include a plurality of separate motors for separately engaging the first rotatable member 55', the second rotatable member 57', and the third rotatable member 59', respectively. According to other exemplary embodiments, the motor 61' may be configured to engage and rotate the third rotatable member 59' in other ways besides a gear arrangement. In this manner, the seat 50' can be automatically, and independently, rotated about the angled axis 124' in a similar manner as the cover 70'.

As shown in FIG. 3, the opening mechanism 120' further includes a housing 60' for containing the first rotatable member 55', the second rotatable member 57', the third rotatable member 59', and portions of the elongated members 53', 73'. The housing 60' includes an opening 60*a*' for receiving portions of the elongated members 53', 73' therein. The housing 60' may include additional openings to provide an interface between the rotatable members 55', 57', 59' and the one or more separate drive gears of the motor 61', which may be coupled to an inner portion of the base 30'. According to another exemplary embodiment, the housing 60' houses the motor 61' or a plurality of motors 61' therein. The housing 60' may be connected to the base 30' at a mounting plate 32*a*'.

As shown in FIGS. 3, the housing 60' further includes an outer surface 60*b*' that defines a mistake proofing feature (e.g., poke-a-yoke feature) for locating and aligning the housing 60' relative to the base 30'. For example, the housing 60' may include a longitudinal protrusion on the outer surface 60*b*' that is configured to engage a complementary feature defined by an inner surface 32*b*' of the base 30' that defines an opening 32', so as to align and detachably couple the housing 60' to the base 30'. The housing 60' and/or the base 30' may include a fastening arrangement for detachably coupling the housing 60' to the base 30', such as snap-fit features, bayonet features, or other types of fastening arrangements to allow the housing 60' to be removable from the base 30'. In this way, the cover 70' and the seat 50' may be selectively removed from the base 30' via the housing 60' as a seat and cover sub-assembly 140', so as to allow for repair, maintenance, or cleaning of the various components of the toilet 20'.

Referring to FIGS. 3, the opening mechanism 120' allows the cover 70' and the seat 50' to each be pivoted or rotated backward about an angled axis 124' in order to move between the lowered position 72' and the stowed position 74'. The angled axis 124' is an axis that extends in an upward direction at an angle relative to the vertical and longitudinal axes (e.g., an oblique angle) forward toward a front end 42' of the base 30' (where the vertical axis (i.e., the z-axis) extends vertically along the height of the base 30' and the longitudinal axis (i.e., the x-axis) extends horizontally along the depth of the base 30' (i.e., between the front end 42' and the back end 44' of the base 30'). The angled axis 124' extends through the elongated members 53', 73' lengthwise through the opening 53*a*'. The lateral axis (i.e., the y-axis), the vertical axis (i.e., the z-axis), and the longitudinal axis (i.e., the x-axis) are substantially perpendicular to each other.

Figure 4:
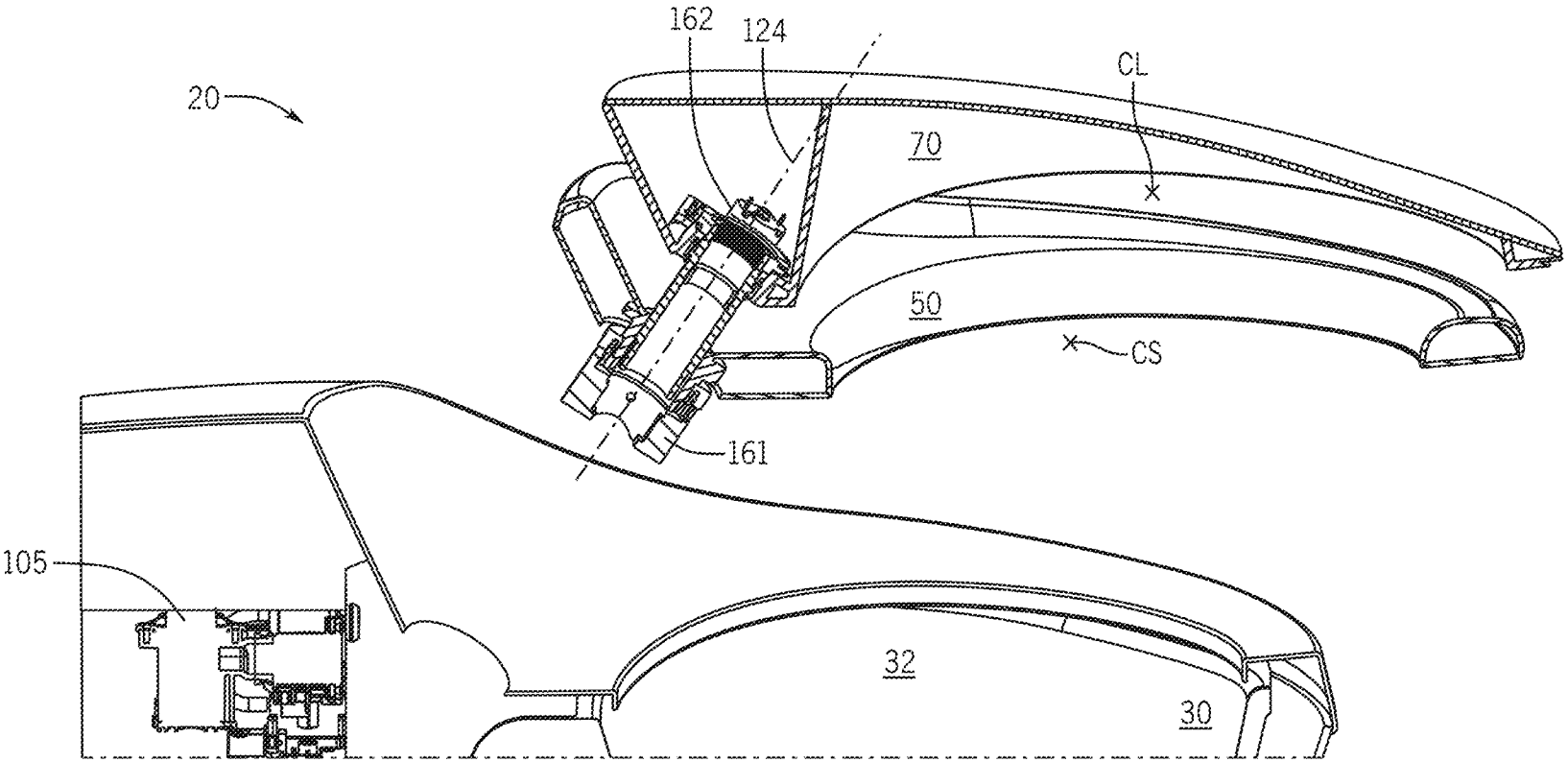
FIG. 4 illustrates a reference center of mass for the cover and seat opening mechanism.

FIG. 4 illustrates a reference center of mass for the cover and seat opening mechanism for toilet 20. The center of mass for the lid CL and the center of mass for the seat CS is above the bowl and spaced apart from the pivot axis 124 by a substantial distance. The substantial distance may be 10 cm, 20 cm, or more. The substantial distance may be at least 20% or more of the diameter of the corresponding seat 50 or cover 70. The center of mass for the lid CL may be above the bowl 32 of the base 30. The center of mass for the seat CS may be above the bowl 32 of the base 30.

Also illustrated in FIG. 4, is a flush engine 105. The flush engine 105 may include one or more valves and one or more pumps to deliver water to the bowl 32. The flush engine 105 may be fluidly coupled to a rim opening or nozzle and/or a siphon-jet opening. The rim opening or nozzle is typically positioned around an inner perimeter of the toilet bowl such that water flows through a waterway in the rim or directly from near the rim at a rim nozzle. The siphon-jet opening is typically positioned in a lower or bottom portion of the toilet bowl, such that water flows from directly to the bottom of the toilet bowl and into the trapway, which draws out or pushes out all of the water and waste from the bowl and into the drain by creating a siphon effect.

Figure 5:
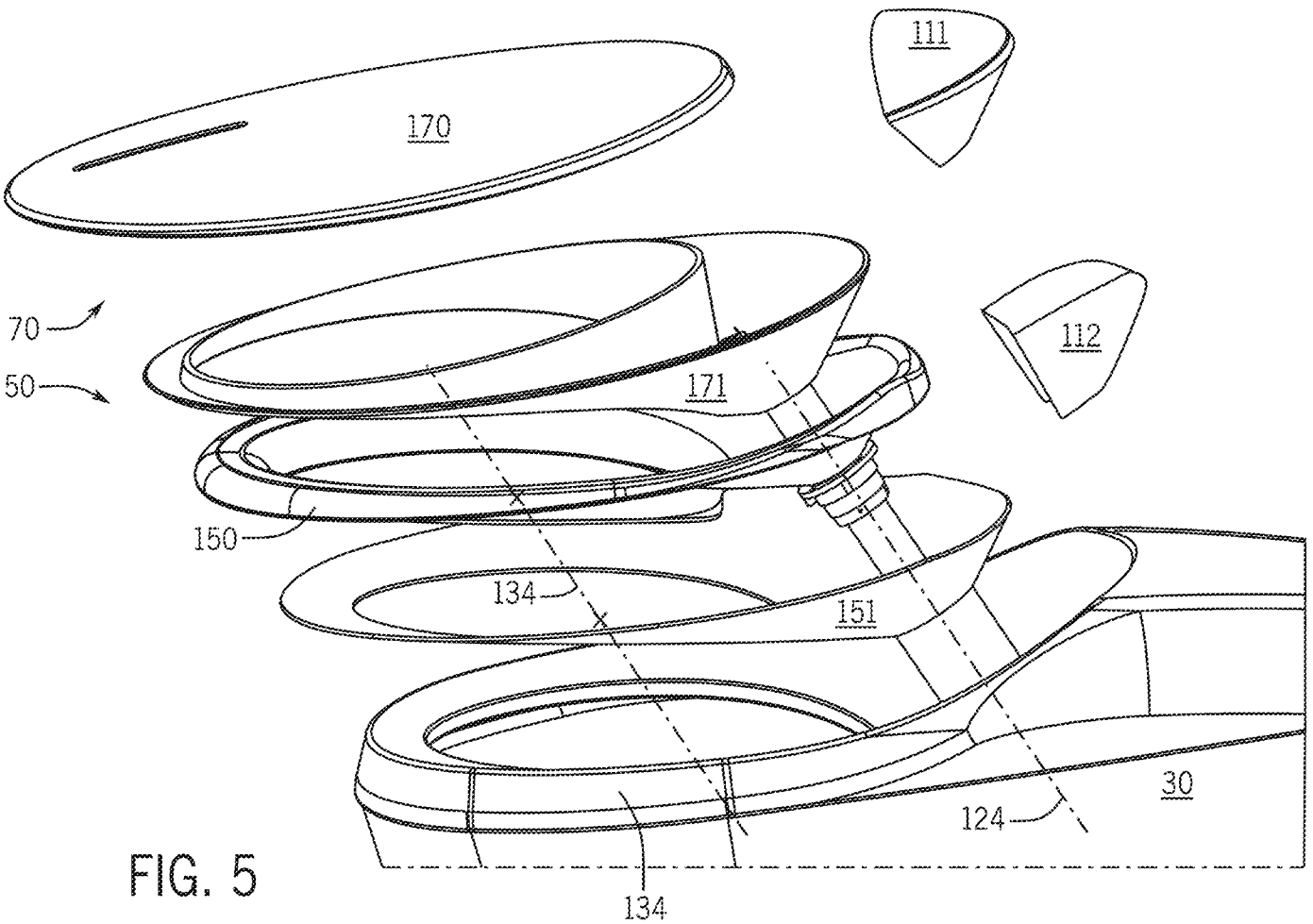
FIG. 5 illustrates example housings and counterweight placement for the cover and seat opening mechanism.

FIG. 5 illustrates example housings and counterweight placement for the cover and seat opening mechanism. The seat 50 and cover 70 rotate about the pivot axis 124. The seat 50 and cover 70 may rotate about different axes (e.g., the seat axis may be offset from the cover axis). The cover 70 may include a top housing 170 and a bottom housing 171. The top housing 170 and bottom housing 171 fit together forming a cavity in the cover 70. The cavity may contain and support a counterweight 111. The counterweight 111 is fixedly coupled to the cover 70. The counterweight 111 causes the center of mass of the cover 70, previously at CL near or along line 134 to a new location near axis 124. The counterweight 111 causes a center of mass of the cover 70 to be spaced from a geometric center of the cover. The center of mass of the cover 70 may be on the pivot axis 124 (e.g., the pivot axis 124 may intersect the center of mass). The center of mass of the cover 70 may be a predetermined distance from the pivot axis 124. Example distances may be within 1 centimeter.

The seat 50 may include a top housing 150 and a bottom housing 151. The top housing 150 and the bottom housing fit together forming a cavity in the seat 50. The cavity in the seat 50 may contain and support a counterweight 112. The counterweight 112 may be fixedly coupled to the seat 50. The counterweight 112 causes the center of mass of the seat 50, previously at CS near or along line 134 to a new location near axis 124. The counterweight 112 causes a center of mass of the seat 50 to be spaced from a geometric center of the seat 50. The center of mass of the seat 50 may be a predetermined distance from the pivot axis 124. Example distances may be within 1-3 centimeter.

In some examples, the seat 50 is coupled to a seat shaft that rotates the seat 50 and the cover 70 is coupled to a cover shaft that rotates the cover 70. The seat shaft may pass through the cover shaft or vice versa. Thus, the seat shaft and the cover shaft may be concentric. The counterweights 111 and 112 may also include openings for the shafts. The seat shaft may pass through the opening in the counterweight 112. The cover shaft may pass through the opening in the counterweight 111 and the opening in the counterweight 112.

Figure 6:
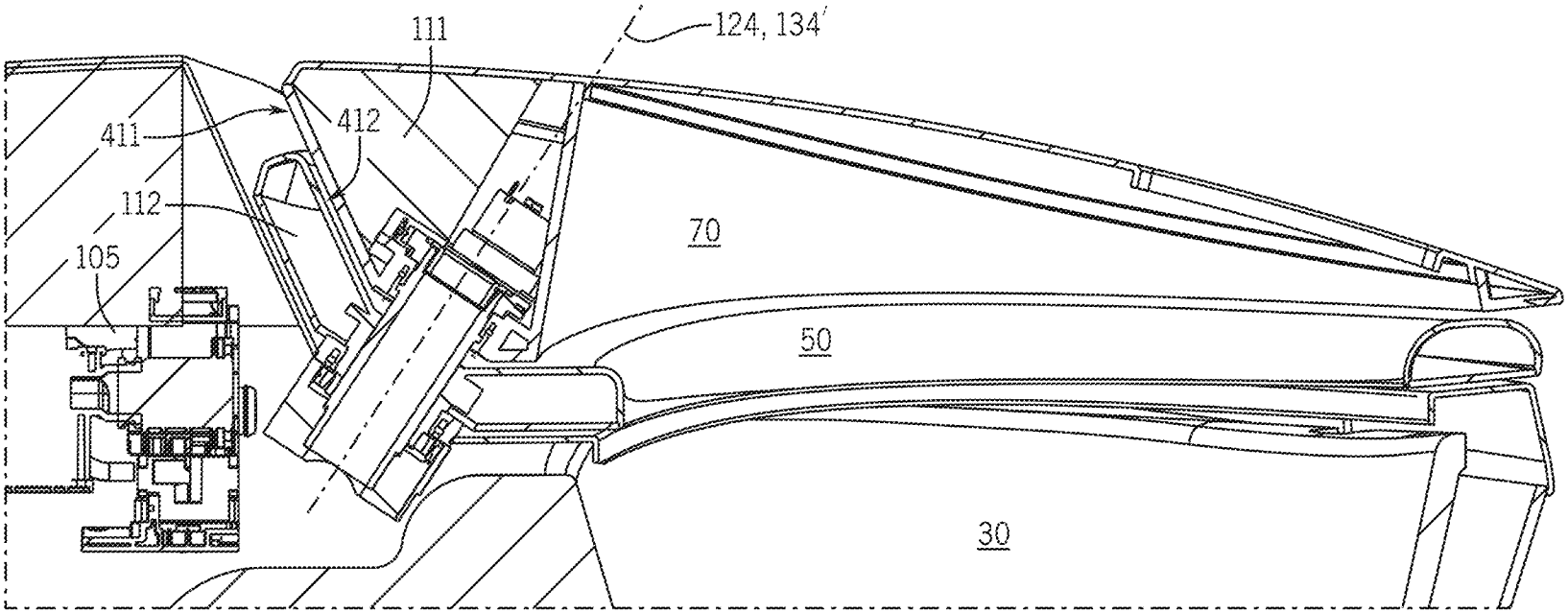
FIG. 6 illustrates the center of mass for the cover and seat opening mechanism as modified by the counterweight placement.

Various placements are possible for the counterweight 111 and counterweight 112. FIG. 6 illustrates ran example placements where the counterweight 111 and counterweight 112 are placed behind the axis 124. That is the counterweight 111 and counterweight 112 are located on the other side of the axis 124 as compared to the opening in the seat 50. In the example of FIG. 6, the counterweights 111 and 112 are placed behind the pivot axis. The counterweights include at least one curved surface 412 and 411 that are substantially parallel. In some examples, a cross section of counterweight 112 has a quadrilateral shape and a cross section of counterweight 111 has a triangular shape.

The counterweight 111 and counterweight 112 may be formed of various materials. The material may have a density or specific gravity greater than a threshold value. The material may have a density or specific gravity greater than the rest of the cover 70 or seat 50. The material may be metal or stone. The material may include iron, steel, or tungsten. The material may include sand or ball bearings. The material may be a composite or resin.

Figure 7:
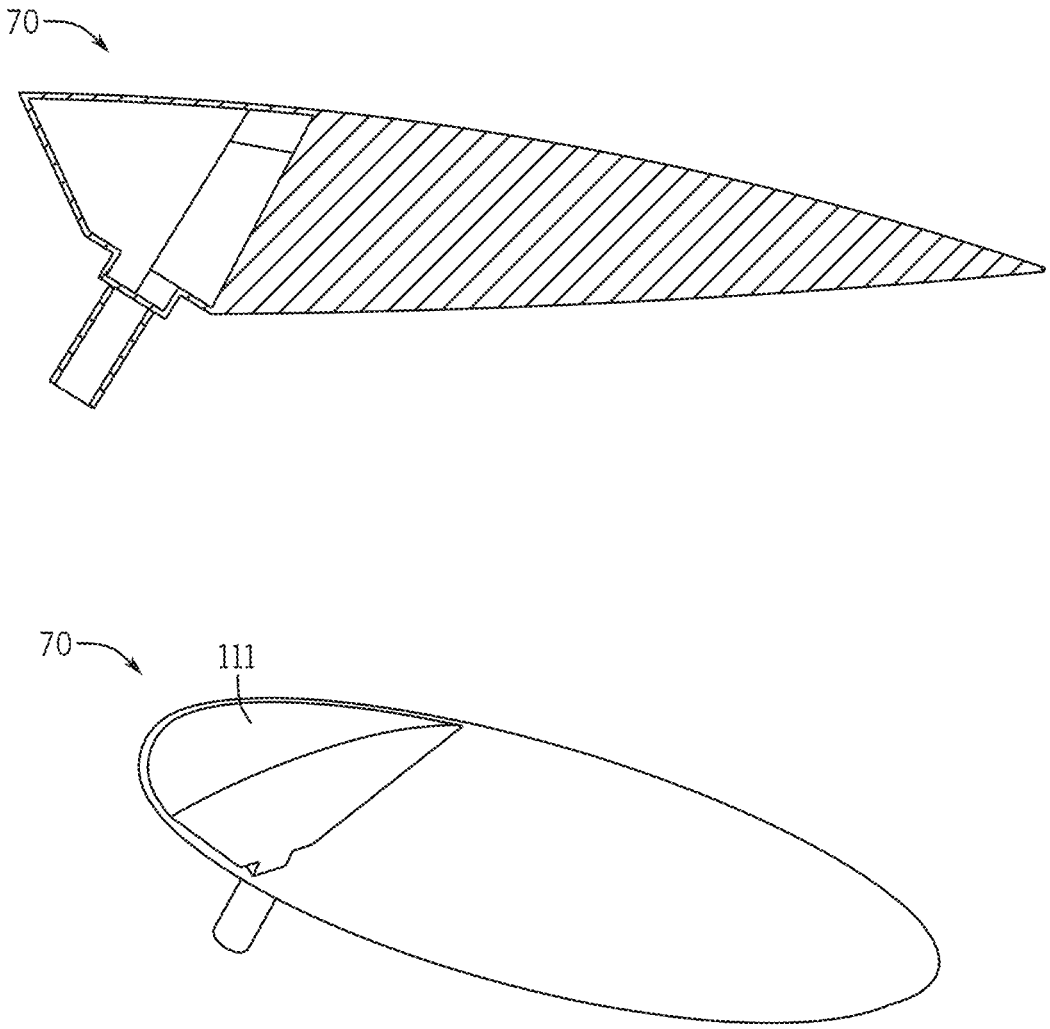
FIG. 7 illustrates an example cover and cover counterweight.

FIG. 7 illustrates an example cover 70 and cover counterweight 111. In this example, the counterweight 111 is formed of iron having an approximate density of 7 grams/$cm^3$. The density of the counterweight 111 is several times greater than the density of the rest of the cover 70. The cover 70 may be formed from ABS having an approximate density of 1 gram/$cm^3$.

Figure 8:
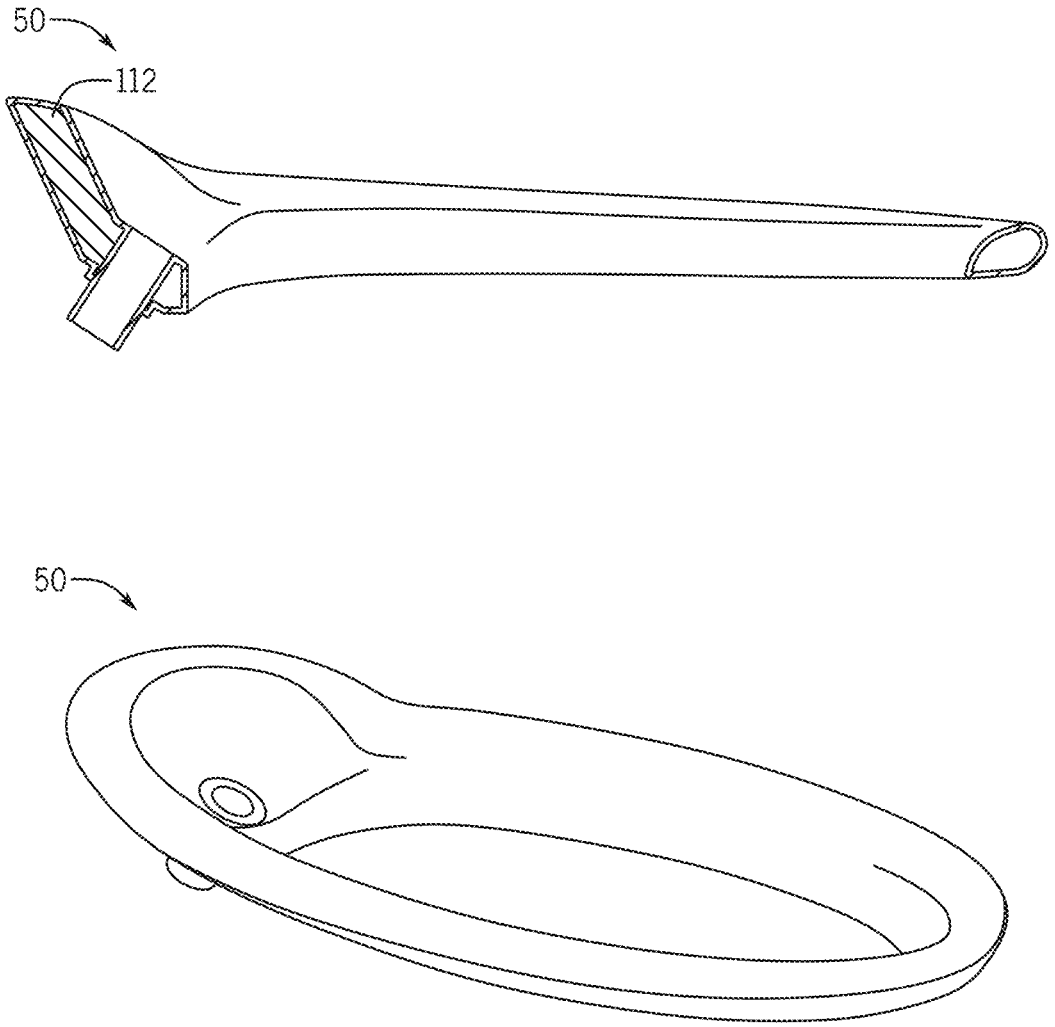
FIG. 8 illustrates an example seat and seat counterweight.

FIG. 8 illustrates an example seat 50 and seat counterweight 112. In this example, a density of the counterweight 112 is greater than a density of the seat 50. For example, the counterweight 112 is formed of iron having an approximate density of 7 grams/$cm^3$. The density of the counterweight 112 is several times greater than the density of the rest of the seat 50. The seat 50 may be formed from a plastic or thermoplastic polymer having an approximate density of 1 gram/$cm^3$. One example of the thermoplastic polymer is acrylonitrile butadiene styrene (ABS).

Figure 9:
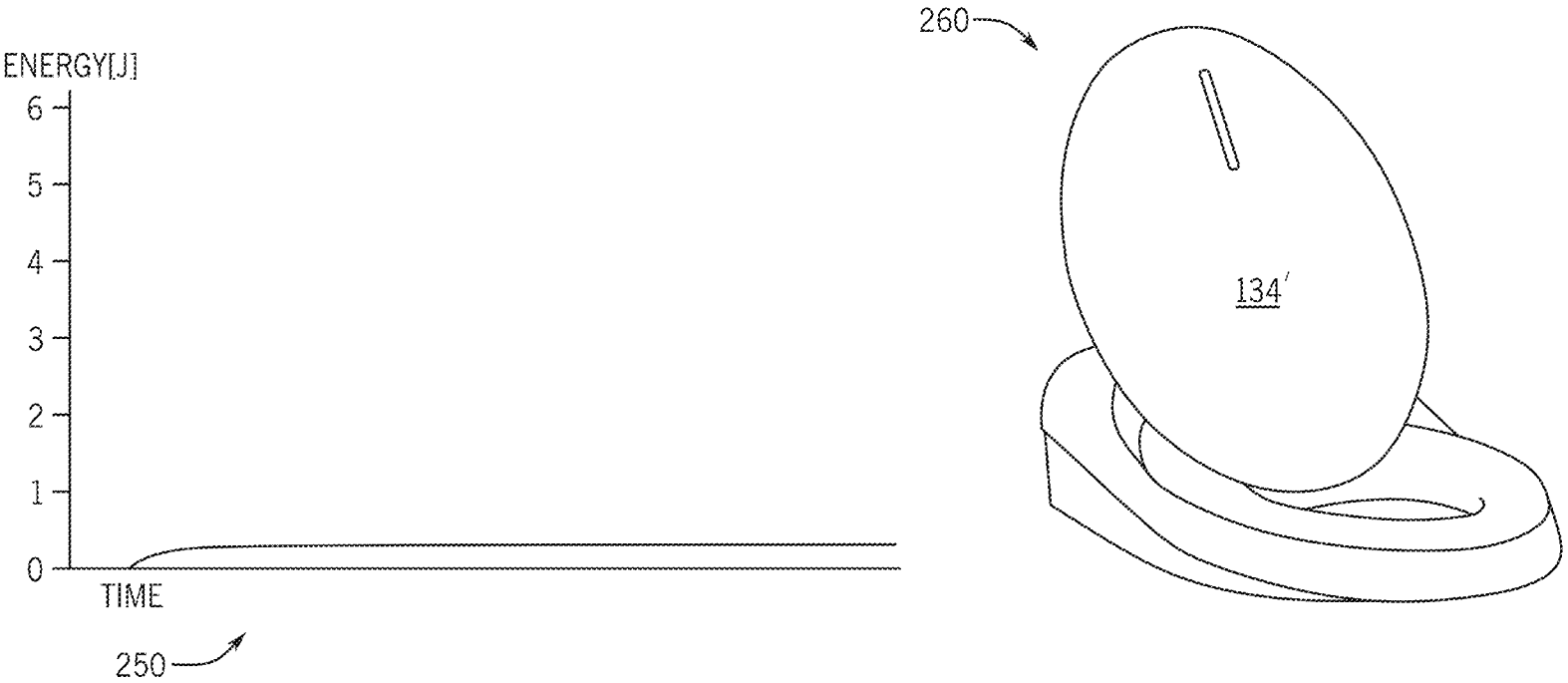
FIGS. 9 and 10 illustrates an example chart of energy efficiency.
Figure 10:
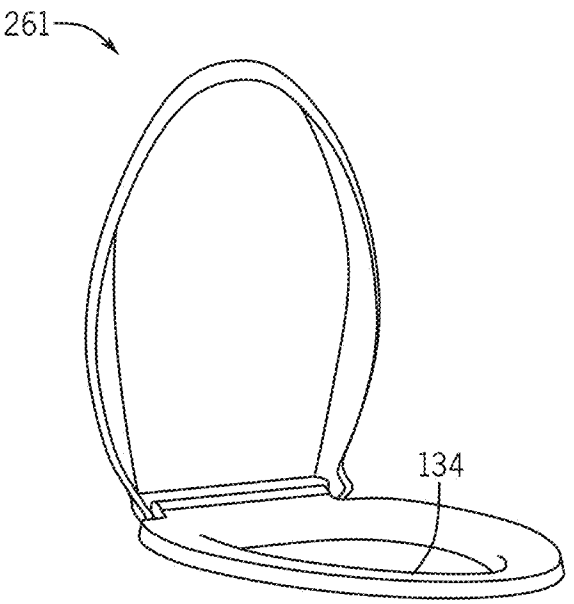
Figure 10:
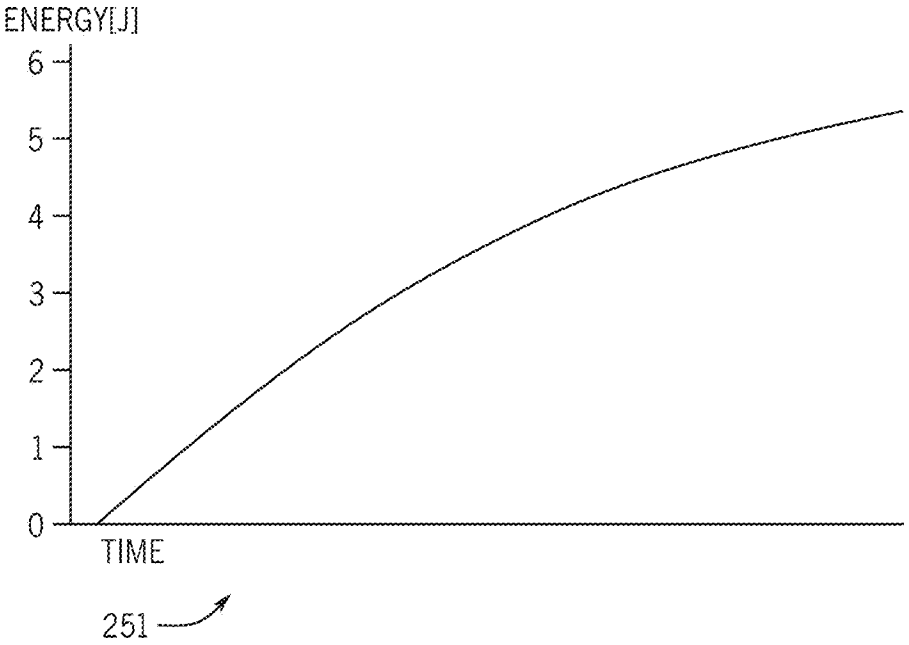

FIGS. 9 and 10 illustrate example charts of energy efficiency comparing the pivoting toilet seat assembly including a pivot axis and counterweight to a conventional toilet seat. Because the counterweights 111 and 112 balance the seat 50 and cover 70, the seat 50 and cover 70 can be rotated by a motor using low power. As an alternative to a motor, one or more solenoids may be used to open and close the seat 50 and cover 70.

FIG. 9 illustrates that a motor rotating a pivoting toilet seat assembly 260 uses about 0.26 Joules, as shown in chart 250. FIG. 10 illustrates that a motor lifting a conventional toilet seat 261 may use over 4 Joules, as shown in chart 251. The motor or multiple motors, or other drive mechanism, may receive power (e.g., stored electrical energy) from one or more batteries. In other examples, the drive mechanism receives power from a power converter (e.g., AC to DC converter) connected to an electrical outlet.

In one example, the drive mechanism (e.g., motor) may be driven by a pulse width modulation (PWM) signal. The PWM signal may be selected to selectively and intermittently reduce or remove power from the drive mechanism (e.g., motor) at predetermined times so that the movement of the seat 50 and/or cover 70 coasts or operates at a reduced power. This technique may reduce power consumption of the drive mechanism. Further, energy reduction may be achieved by including circuitry to recover energy from a back electromotive force (EMF) that the motor observes when the load is coasting and back driving the drive mechanism. The EMF force may provide electrical energy that is directed to a storage device such as a battery or supercapacitor.

In one example, the power required to open and close the cover 70 including the counterweight 111 is reduced compared to a toilet cover on a typical hinge assembly, and the power required to open and close the seat 50 is reduced compared to a toilet cover on a typical hinge assembly. In one example, the average power for each of the operations is reduced by approximately a factor of three.

Figure 11:
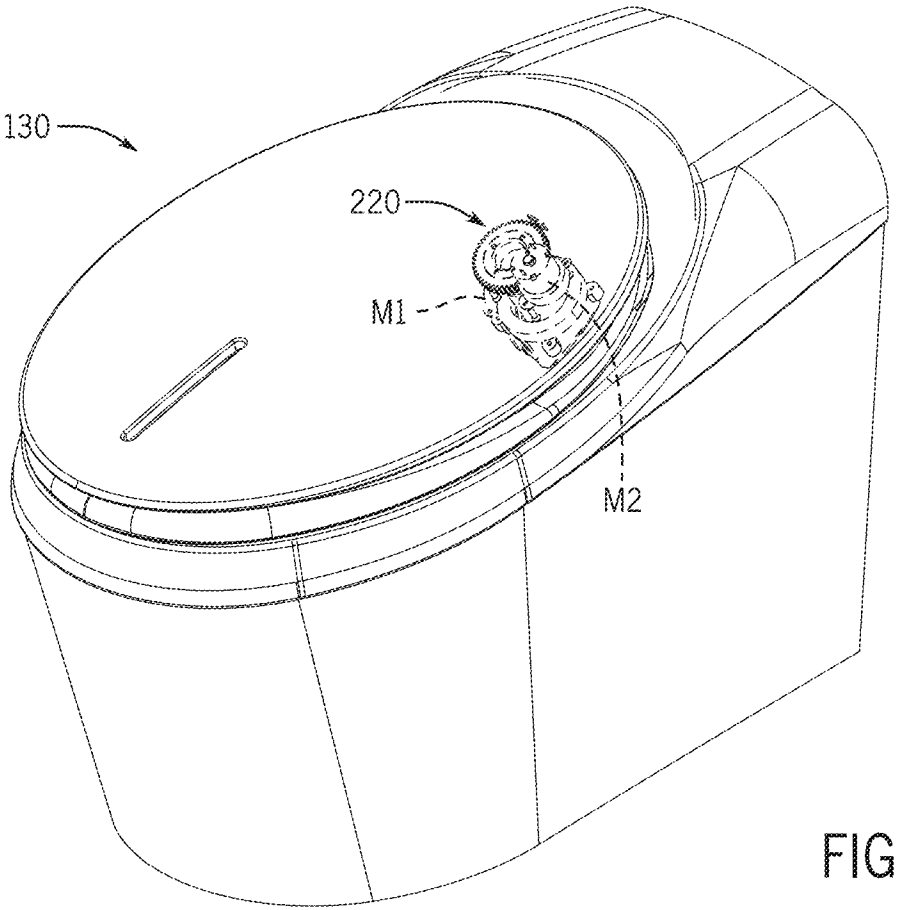
FIG. 11 illustrates an example drive mechanism for the cover and seat opening mechanism.

FIG. 11 illustrates an example drive mechanism 220 for the cover and seat opening mechanism of toilet 130. The drive mechanism 220 may include a single motor coupled to a first drive train for the seat 50 and a second drive train for the cover 70. As illustrated, the drive mechanism includes a first motor M1 for the seat 50 and a second motor M2 for the cover 70.

Figure 12:
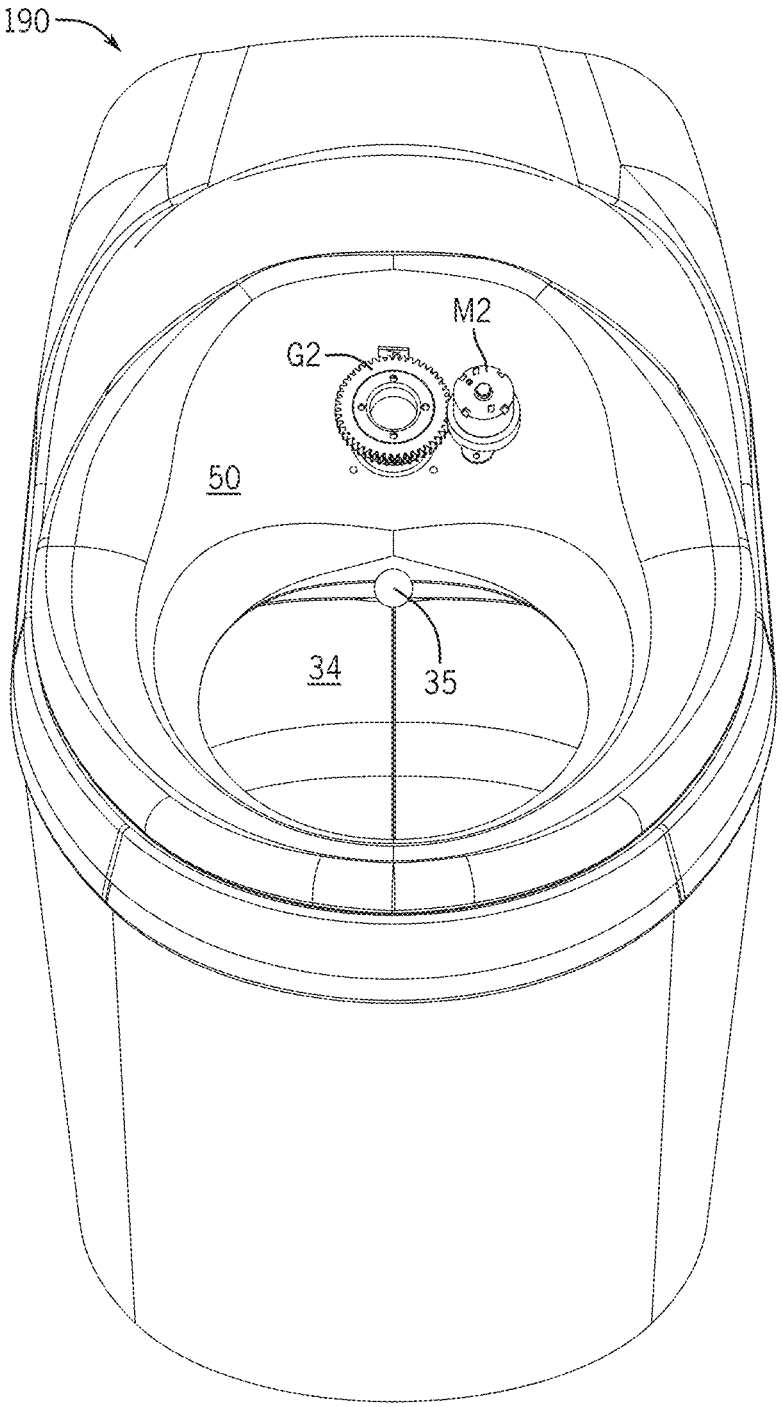
FIG. 12 illustrates an example drive mechanism for the cover and seat opening mechanism.

FIG. 12 illustrates a toilet 140 including an example drive mechanism for the cover 70. The drive mechanism for the cover 70 includes second motor M2 and at least one gear G2. Both the second motor M2 and the at least one gear 108 may be located above the seat 50. That is, the second motor M2 and the at least one gear 108 may be located between the bottom housing 171 of the cover 70 and the top housing 150 of the seat 50.

Figure 13:
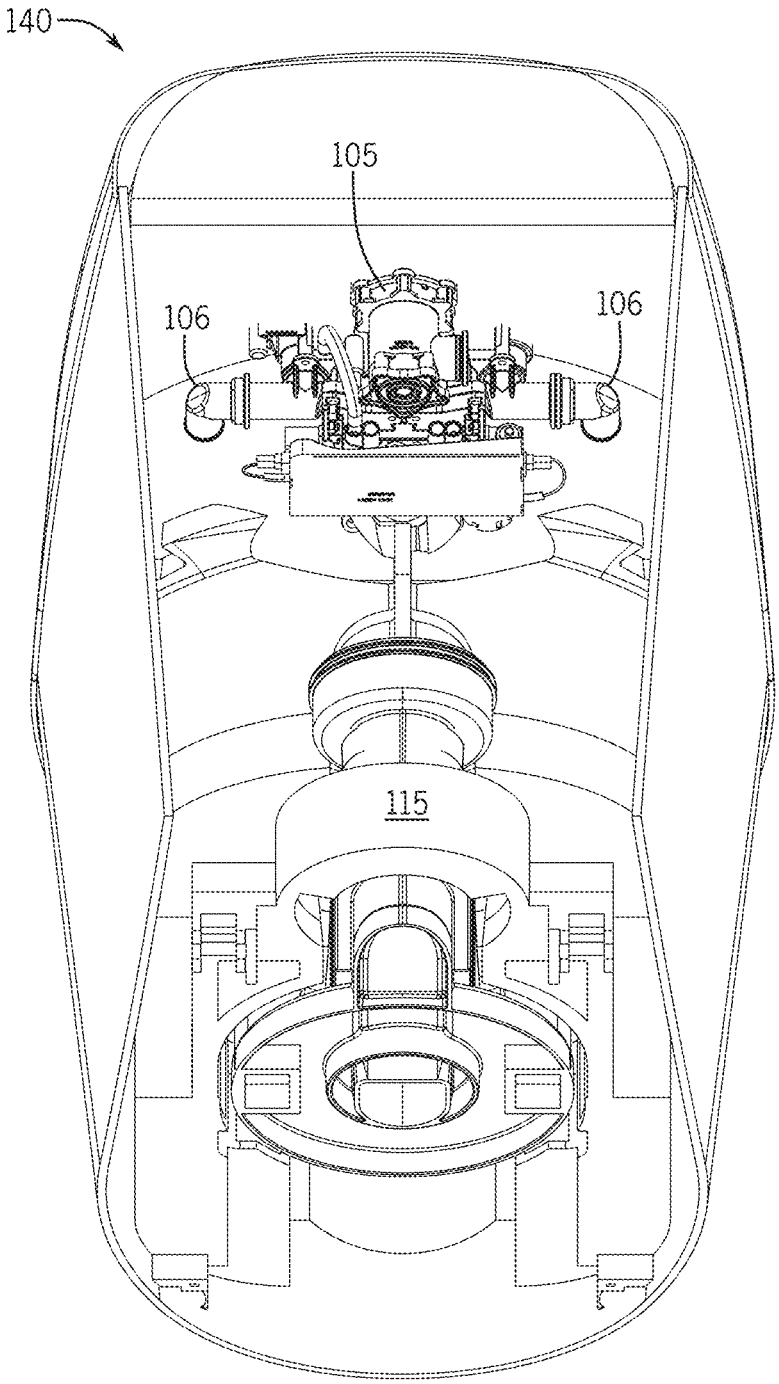
FIG. 13 illustrates a portion of the example water systems for the toilet.

FIG. 13 illustrates a toilet 140 with a water system for operation of the toilet 140. As, shown valve control system in the flush engine 105 may include an array of valves for turning on an off water streams to flush the toilet 140. At least one valve may control a flow of water to rim passages 106 for a rim wash. At least one valve may control a flow of water to a sump jet 118 (as shown in FIG. 13) to help evacuate the contents of the bowl. Shown from the rear, a trapway 115 provides a path of water from the sump of the bowl to the exit (e.g., sewer pipe) of the toilet 140. A spray device 35 may be mounted on the base 30 under the seat 50. The spray device 35 may be a bidet configured to a spray water on a user seated at the toilet. The spray device 35 may be mister may be mounted on the base 30 and configured to spray the seat 50 or other areas. The mister may spray a cleaning solution or water with a cleaning compound that is stored in a tank fluidly coupled to the tank. The spray device 35 may be electrically coupled a spray device control circuit. The spray device control circuit is configured to control the spray device 35 to turn ON and OFF. The spray device control circuit is configured to operate the spray device 35 in a predetermined mode (e.g., high volume, low volume). The spray device control circuit may receive inputs from a user switch or button. The spray device control circuit may receive inputs from a user sensor (e.g., pressure sensor). The spray device control circuit may operate independently from the controller 301. Alternate locations of the spray device 35 are shown in dotted lines.

Figure 14:
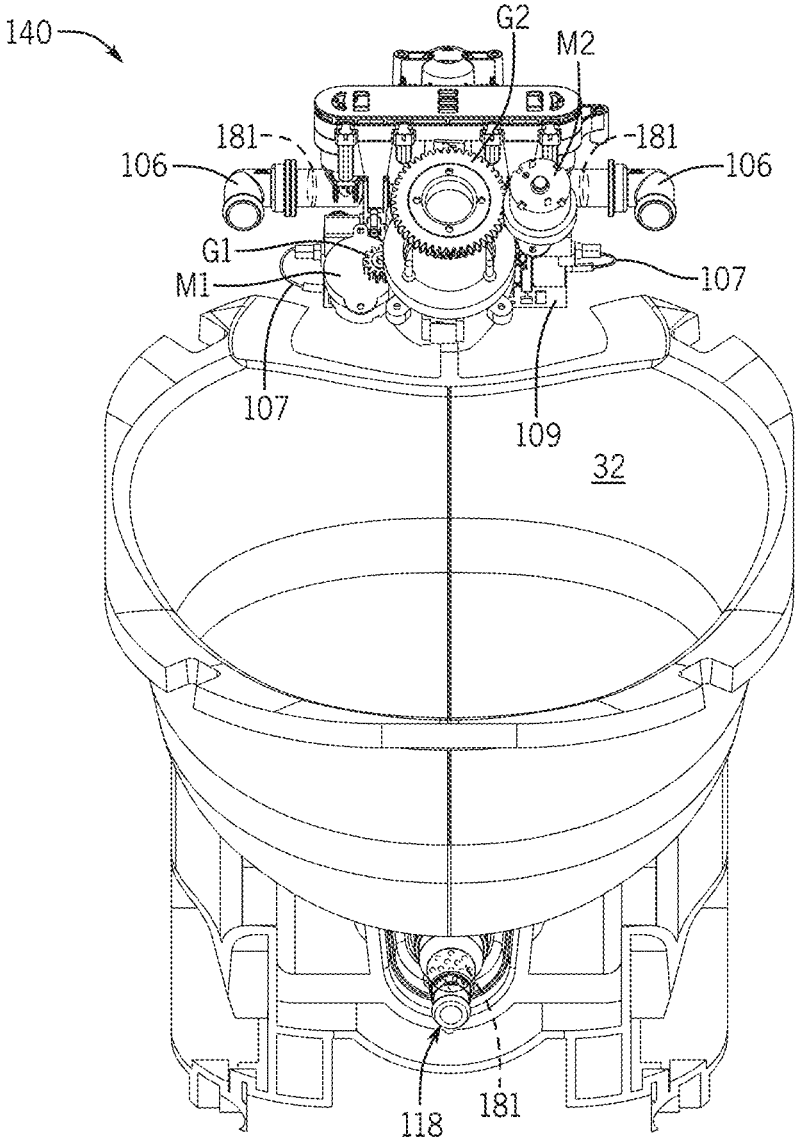
FIG. 14 illustrates a portion of the example drive mechanism and water system for the toilet.

FIG. 14 illustrates another view of the toilet 140 a portion of the example drive mechanism for the cover and seat opening mechanism. A battery 109 may be connected via wires 107 to each of the motors M1 and M2. Motor M1 provides mechanical power to rotate the cover 70 through a drive train including at least gear G1. Motor M2 provides mechanical power to rotate the seat through a drain training including at least gear G2. The toilet 140 may further include a sump jet 118. In any of the disclosed embodiments, the battery 109 may be omitted and an alternating current (AC) supply (e.g., water outlet) may be used. The AC supply may be converter to direct current (DC) by a power transformed that is coupled to the toilet 140.

In one alternative embodiment, illustrated by FIG. 14, a turbine 181 (hydraulic turbine) may be included in a water path. The turbine 181 may be configured to generate power (i.e., electric current) as fluid flows past the turbine 181. Specifically, the turbine 181 may include an impeller disposed in a pathway or conduit through which fluid (e.g., water) flows. As water flows through the pathway or conduit in which the impeller is disposed, water may contact the impeller, causing the impeller to rotate. The hydraulic turbine 181 may include one or more magnets and one or more coils configured to generate power as fluid flows passed the impeller, rotating the impeller.

The turbine 181 may be in fluid communication with and receive a flow of water from the water supply. The turbine 181 may also be in fluid communication with a rim passage 106 and/or a sump jet 118, as illustrated. The turbine 181 may be electrically connected to the battery 109 and/or controller. The battery 109 may be configured to store power generated by the turbine 181. In some examples, power generated by the turbine 181 may travel through the controller before being stored in the battery 109. The battery 109 and/or controller may be configured to provide power stored in the battery 109 to one or both of the motors M1 and M2. For example, power generated by the turbine 181 may directly energize, or through battery 109, cause rotation for the first motor M1 to rotate the seat 50 including the counterweight 112 and power generated by the turbine 181 may directly energize, or through battery 109, cause rotation for the second motor M2 to rotate the cover 70 including the counterweight 111. The power generated by the turbine 181 may directly energize, or through battery 109, cause rotation for the motor 61' to rotate the seat 50 including the counterweight 112 and the cover 70 including the counterweight 111. The turbine 181, the battery 109 and/or the controller may be configured to provide power stored in the battery 109 to one or more components of the system for flushing a toilet (e.g., valves, pumps). The power generated by the turbine 181 may directly energize, or through the battery 109, causes one or more indicators or display to provide a status or command for the flush engine 105. The power generated by the turbine 181 may directly energize, or through the battery 109, causes one or more indicators or display to provide a status or command for cover 70 and/or seat 50.

Figure 15:
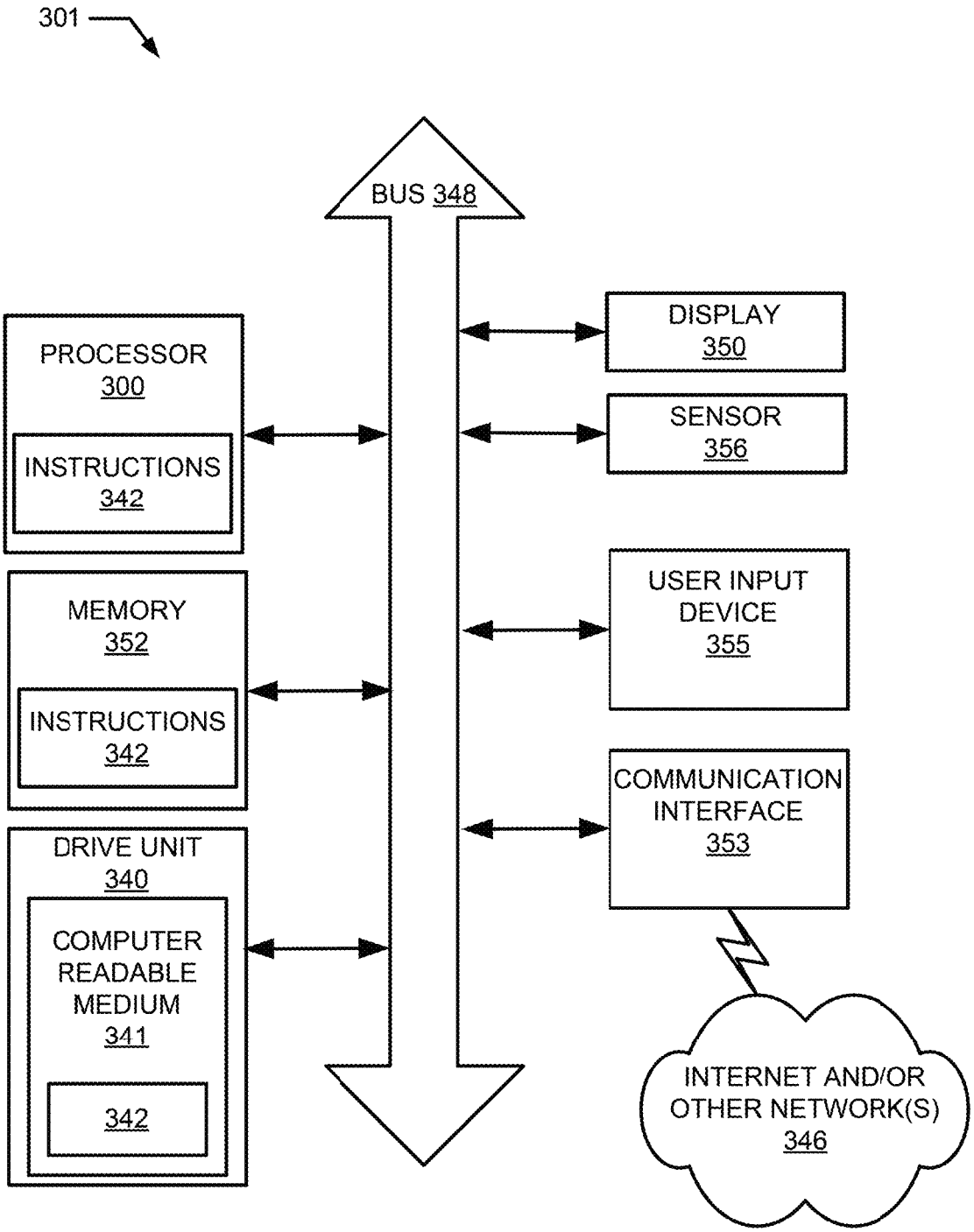
FIG. 15 illustrates an example controller for the examples of FIGS. 1-14.

FIG. 15 illustrates an example controller 301 for operation of the drive mechanism for seat 50 and cover 70. The controller 301 may include a processor 300, a memory 352, and a communication interface 353 for interfacing with devices or to the internet and/or other networks 346. In addition to the communication interface 353, a sensor interface may be configured to receive data from sensors (e.g., proximity sensors to trigger the operation of the seat 50 and/or cover 70; position sensors to detect the position of the seat 50 and/or cover).

The components of the control system may communicate using bus 348. The control system may be connected to a workstation or another external device (e.g., control panel) and/or a database for receiving user inputs, system characteristics, and any of the values described herein.

Optionally, the control system may include an input device 355 and/or a sensing circuit 356 in communication with any of the sensors. The sensing circuit receives sensor measurements from sensors as described above. The input device may include any of the user inputs such as buttons, touchscreen, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be an indicator or other screen output device. The display 350 may be combined with the user input device 355.

Figure 16:
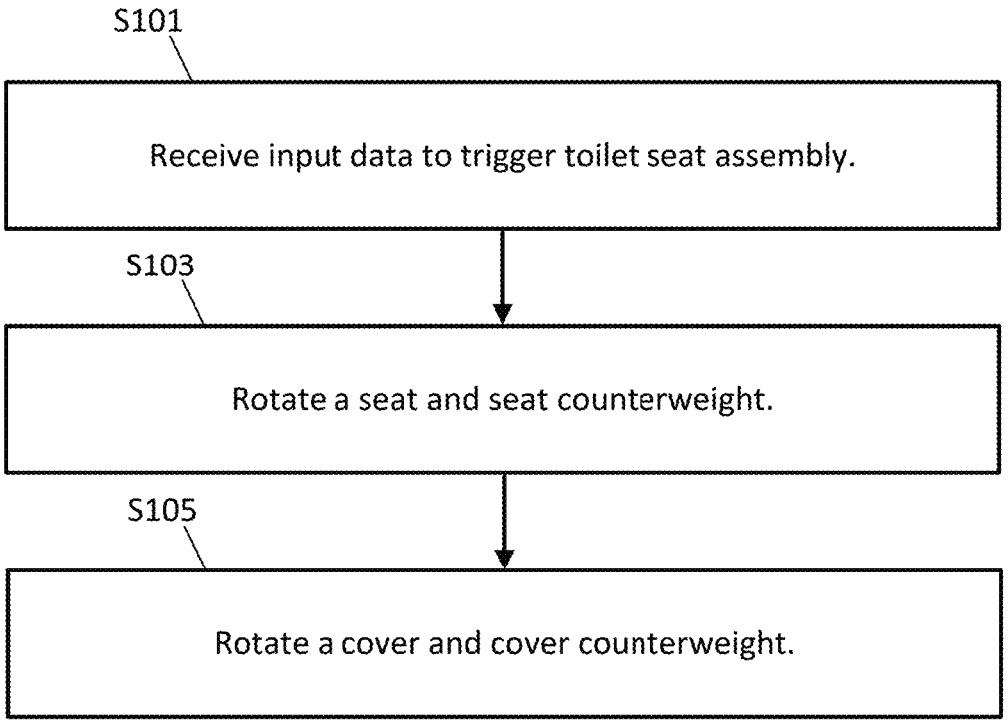
FIG. 16 illustrates a flow chart for the apparatus of FIG. 15.

FIG. 16 illustrates a flow chart for the apparatus of FIG. 15. The acts of the flow chart may be performed by the controller 301. Additional, different of fewer acts may be included.

At act S101, the controller 301 (e.g., processor 300) receives input data to trigger the operation of the toilet seat assembly. The data input may include data from a sensor such as a proximity sensor that detects a user approaching the toilet or providing a gesture to the toilet. The input data may be received from a remote control or mobile device operated by the user. The input data may specify seat opened or seat closed and/or cover opened or cover closed.

At act S103, the controller 301 (e.g., processor 300) generates a first signal to rotate a seat and a seat counterweight. The first signal may turn on motor M1 or another drive mechanism. The first signal may specify a predetermined angle of rotation for the seat.

At act S105, the controller 301 (e.g., processor 300) generates a second signal to rotate a cover and a cover counterweight. The second signal may turn on motor M2 or another drive mechanism. The second signal may specify a predetermined angle of rotation for the cover.

A center of mass of the seat is spaced from a geometric center of the seat and a center of mass of the cover is spaced from a geometric center of the cover.

Processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, memory 298 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A toilet comprising:

a base;

a seat rotatably coupled to the base on an angled pivot axis shaft at an angle relative to a vertical axis and at an angle relative to a horizontal axis;

a first counterweight fixedly coupled to the seat, wherein the first counterweight causes a center of mass of the seat to be spaced from a geometric center of the seat;

a cover rotatable on the angled pivot axis shaft; and a second counterweight fixedly coupled to the cover, wherein the second counterweight causes a center of mass of the cover to be spaced from a geometric center of the cover, wherein the angled pivot axis shaft passes through a first opening of the first counterweight or a second opening of the second counterweight.

2. The toilet of claim 1, wherein the center of mass of the seat is within a predetermined distance of the pivot axis.

3. The toilet of claim 1, wherein the center of mass of the cover is within a predetermined distance of the pivot axis.

4. The toilet of claim 1, wherein the pivot axis shaft includes a first shaft coupled to the cover and a second shaft coupled to the seat.

5. The toilet of claim 1, wherein a majority of the second counterweight is on a first side of the pivot axis shaft and a majority of the cover is on a second side of the pivot axis shaft.

6. The toilet of claim 1, wherein a majority of the first counterweight is on a first side of the pivot axis shaft and a majority of the seat is on a second side of the at least one pivot axis shaft.

7. The toilet of claim 1, wherein the seat includes a seat housing enclosing the first counterweight.

8. The toilet of claim 1, wherein the cover includes a cover housing enclosing the second counterweight.

9. The toilet of claim 1, further comprising:

a motor configured to rotate the seat or the cover; and a battery configured to store electrical energy to operate the motor.

10. The toilet of claim 1, wherein the first counterweight or the second counterweight includes a metal.

11. The toilet of claim 1, wherein the toilet is a tankless toilet.

12. A drive mechanism for a toilet, the drive mechanism comprising:

a motor;

a first gear driven by the motor to rotate a seat housing of the toilet, the seat housing including a first counterweight; and a second gear driven by the motor to rotate a cover housing of the toilet about a angled pivot axis at an angle relative to a vertical axis and at an angle relative to a horizontal axis, the cover housing including a second counterweight fixedly coupled to the cover.

13. The drive mechanism of claim 12, wherein the first counterweight causes a center of mass of the seat to be spaced from a geometric center of the seat and the second counterweight causes a center of mass of the cover to be spaced from a geometric center of the cover.

14. The drive mechanism of claim 12, further comprising:

a battery configured to store energy and supply the stored energy to the motor.

15. The drive mechanism of claim 12, further comprising:

a power converter to supply current to the motor.

16. The drive mechanism of claim 12, further comprising:

at least one pivot axis shaft, wherein the at least one pivot axis shaft passes through a first opening of the first counterweight or a second opening of the second counterweight.

17. A method for automatic operation of a toilet seat assembly, the method comprising:

receiving input data to trigger the operation of the toilet seat assembly;

generating a first signal to rotate a seat and a seat counterweight about an angled pivot axis at an angle relative to a vertical axis and an angle relative to a horizontal axis; and generating a second signal to rotate a cover and a cover counterweight, wherein a center of mass of the seat is spaced closer to the angled pivot axis than a geometric center of the seat and a center of mass of the cover is spaced closer to the angled pivot axis than a geometric center of the cover.

* * * * *